US009108333B2

(12) United States Patent
Lee

(10) Patent No.: US 9,108,333 B2
(45) Date of Patent: Aug. 18, 2015

(54) PUNCHING DEVICE

(71) Applicant: Chung-Yi Lee, New Taipei (TW)

(72) Inventor: Chung-Yi Lee, New Taipei (TW)

( * ) Notice: Subject to any disclaimer, the term of this patent is extended or adjusted under 35 U.S.C. 154(b) by 68 days.

(21) Appl. No.: 14/135,848

(22) Filed: Dec. 20, 2013

(65) Prior Publication Data

US 2014/0109741 A1 Apr. 24, 2014

Related U.S. Application Data

(63) Continuation-in-part of application No. 12/705,715, filed on Feb. 15, 2010, now Pat. No. 8,635,936.

(30) Foreign Application Priority Data

Nov. 10, 2009 (CN) ..... 2009 2 0269483 U
Nov. 10, 2009 (TW) ..... 098220823 U

(51) Int. Cl.

| | |
|---|---|
| ***B26F 1/14*** | (2006.01) |
| ***B26D 7/06*** | (2006.01) |
| ***B26D 5/08*** | (2006.01) |
| ***B26F 1/32*** | (2006.01) |
| ***B26D 7/18*** | (2006.01) |
| ***B26F 1/36*** | (2006.01) |

(52) U.S. Cl.

CPC ..... *B26F 1/32* (2013.01); *B26D 7/1818* (2013.01); *B26F 1/36* (2013.01); *Y10T 83/2127* (2015.04); *Y10T 83/8832* (2015.04)

(58) Field of Classification Search

CPC ..... B26F 1/00; B26F 1/02; B26F 1/32; B26F 1/36; B26D 7/1818

USPC ..... 83/109, 111, 129, 168, 588, 621, 627, 83/467.1, 686, 633, 582, 635, 620

See application file for complete search history.

(56) References Cited

U.S. PATENT DOCUMENTS

| | | | |
|---|---|---|---|
| 1,428,174 | A | 9/1922 | Luther |
| 4,791,844 | A | 12/1988 | Yonezawa |
| 5,647,278 | A | 7/1997 | Wu |
| 6,089,137 | A | 7/2000 | Lee |
| 6,428,248 | B1 | 8/2002 | Lee |
| 2002/0092392 | A1 | 7/2002 | Yasoda et al. |
| 2007/0056422 | A1 | 3/2007 | Lee |

*Primary Examiner* — Kenneth E. Peterson
*Assistant Examiner* — Samuel A Davies
(74) *Attorney, Agent, or Firm* — The Webb Law Firm

(57) ABSTRACT

A punching device includes: a base including a die part that has a top wall; an abutting member connected to the base; a punch supported on the base, movable relative to the die part and the abutting member between upper and lower positions; and an ejecting unit supported on the base and including a non-compressible ejecting element disposed above and adjacent to the top wall of the die part. The punch is movable relative to the ejecting unit at least during movement of the punch from a middle position to the lower position. The ejecting unit abuts against the abutting member at least when the punch is disposed at the upper position.

4 Claims, 15 Drawing Sheets

PUNCHING DEVICE

CROSS REFERENCE TO RELATED APPLICATIONS

This application is a continuation-in-part (CIP) of U.S. patent application Ser. No. 12/705,715, filed on Feb. 15, 2010, now U.S. Pat. No. 8,635,936 which claims the priority of Taiwanese Patent Application No. 098220823, filed on Nov. 10, 2009, and Chinese Patent Application No. 200920269483.X, filed Nov. 10, 2009, which are incorporated herein by reference in their entirety.

BACKGROUND OF THE INVENTION

1. Field of the Invention

This invention relates to a punching device, more particular to a punching device including an ejecting unit for preventing a cutout portion of a workpiece cut by a punch from being raised during restoration of the punch to an upper position.

2. Description of the Related Art

As illustrated in FIGS. 1 and 2, U.S. Pat. No. 6,428,248 discloses a conventional punching device that includes a housing 90, a die part 91 mounted in a lower side of the housing 90, and a punch 92 mounted in an upper side of the housing 90 and slidable toward the die part 91 to provide a shear force to cut a workpiece 9 disposed on a top wall of the die part 91. The punch 92 includes inner and outer blades 921, 922 that cooperatively define an accommodating space 920 for receiving an elastic ejecting member 93 therein. As such, the elastic ejecting member 93 is required to have a structure with a pattern the same as that of the accommodating space 920. The die part 91 is formed with holes 910 for extension of the inner and outer blades 921, 922 therein during punching. In operation, when the punch 92 is moved from an upper position (see FIG. 1) to a lower position (see FIG. 2), the elastic ejecting member 93 undergoes a process that it first presses the workpiece 9 against the top wall of the die part 91 when the workpiece 9 is cut to form a desired cutout portion having a pattern the same as that of the accommodating space 920, and is subsequently compressed by the punch 92 and the top wall of the die part 91 as the top wall of the die part 91 is gradually moved into the accommodating space 920 and the inner and outer blades 921, 922 are respectively and gradually moved into the holes 910 in the die part 91. When the punch 92 is restored from the lower position to the upper position, the elastic ejecting member 93 elastically pushes the cutout portion of the workpiece 9 out of the accommodating space 920 so that the cutout portion can remain on the top wall of the die part 91 for subsequent removal therefrom. However, when the pattern of the cutout portion of the workpiece 9 to be produced is complicated or has exceptionally thin segments, manufacture of the elastic ejecting member 93 or a spring, the structure of which has the same pattern as the cutout portion, is difficult and even if the elastic ejecting member 93 can be manufactured, insertion of it into the accommodating space 920 would be very difficult. Moreover, even if the elastic ejecting member 93 can be inserted into the accommodating space 920, the accommodating space 920 would be insufficient to permit deformation of the elastic ejecting member 93.

SUMMARY OF THE INVENTION

Therefore, an object of the present invention is to provide a punching device that can overcome the aforesaid drawbacks associated with the prior art.

According to the present invention, there is provided a punching device for cutting a workpiece to form a cutout portion. The punching device comprises: a base including a die part and a support part that is disposed above and that cooperates with the die part to define an accommodating space for receiving the workpiece therein; an upper housing having a top wall and a surrounding wall that extends downwardly from the top wall and that is formed with a lever opening, the surrounding wall having a lower end that is secured to the support part, and cooperating with the top wall and the support part to define a housing space therebetween; a punch of a single piece disposed in the housing space, supported movably on the support part, movable relative to the die part between upper and lower positions, and having a head wall, a driven protrusion, and outer and inner blades, the head wall having top and bottom surfaces and being formed with a plurality of through-holes that extend through the top and bottom surfaces, the driven protrusion protruding upwardly from the top surface of the head wall, the outer and inner blades extending downwardly from the bottom surface to slide against the die part for cutting the workpiece, and cooperatively defining a gap therebetween; an ejecting unit disposed in the housing space and including a non-compressible ejecting element, a plurality of connecting rods, a horizontal plate, and a first vertical plate, the ejecting element being disposed in the gap below the head wall, the connecting rods extending upwardly from the ejecting element and respectively passing through through the through-holes in the head wall to integrally connect with the horizontal plate, the horizontal plate being disposed on the head wall and being formed with an aperture, the driven protrusion extending through the aperture so as to permit the horizontal plate to be slidably sleeved on the driven protrusion, the first vertical plate extending upwardly from the horizontal plate; an operating lever having a pivot end, an operating free end opposite to the pivot end, and a driving tongue, the pivot end being pivoted to the support part, the operating lever extending through the lever opening in the surrounding wall, such that the operating free end is disposed outwardly of the housing space, the driving tongue being disposed between the pivot end and the operating free end, and protruding therefrom into the housing space to abut against the driven protrusion so as to drive movement of the punch from the upper position to the lower position when the operating lever rotates downwardly relative to the support part; and at least one spring urging the punch for restoring the punch from the lower position to the upper position. When the punch is disposed at the upper position, the first vertical plate abuts against the top wall of the upper housing, the horizontal plate is seated on the top surface of the head wall, and the ejecting element is spaced apart from the die part. When the punch is disposed at the lower position, the first vertical plate is spaced apart from the top wall of the upper housing, the horizontal plate is spaced apart from the head wall, and the ejecting element is seated on the die part.

BRIEF DESCRIPTION OF THE DRAWINGS

In drawings which illustrate embodiments of the invention.

DETAILED DESCRIPTION OF THE PREFERRED EMBODIMENTS

Figure 1:
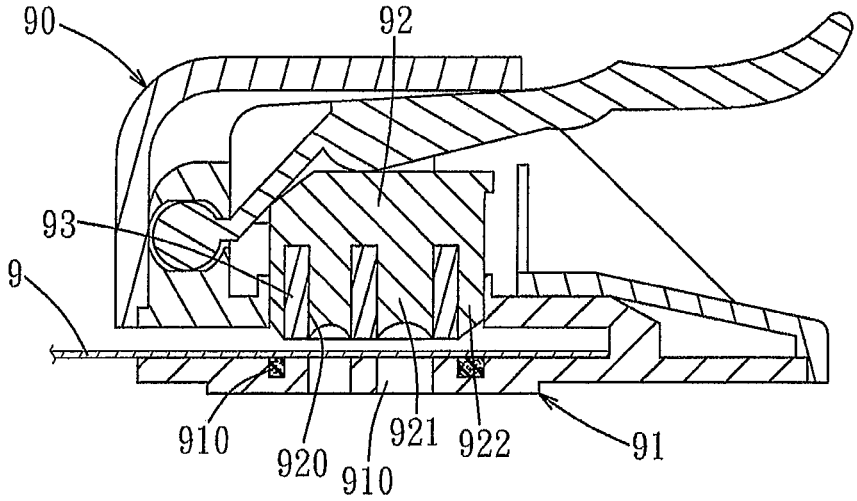
FIG. 1 PRIOR ART
FIG. 1 is a sectional view of a conventional punching device, illustrating a state where a punch thereof is disposed at an upper position.
Figure 2:
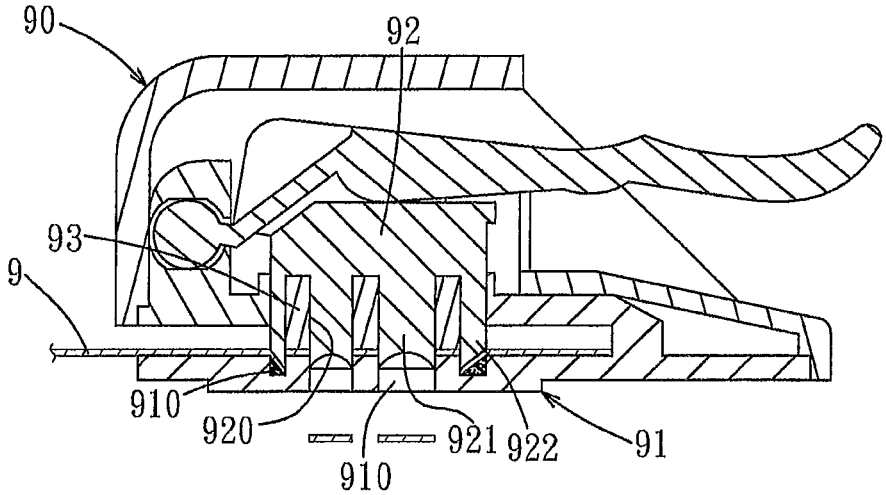
FIG. 2 PRIOR ART
FIG. 2 is a sectional view of the conventional punching device, illustrating another state where the punch is disposed at a lower position.
Figure 3:
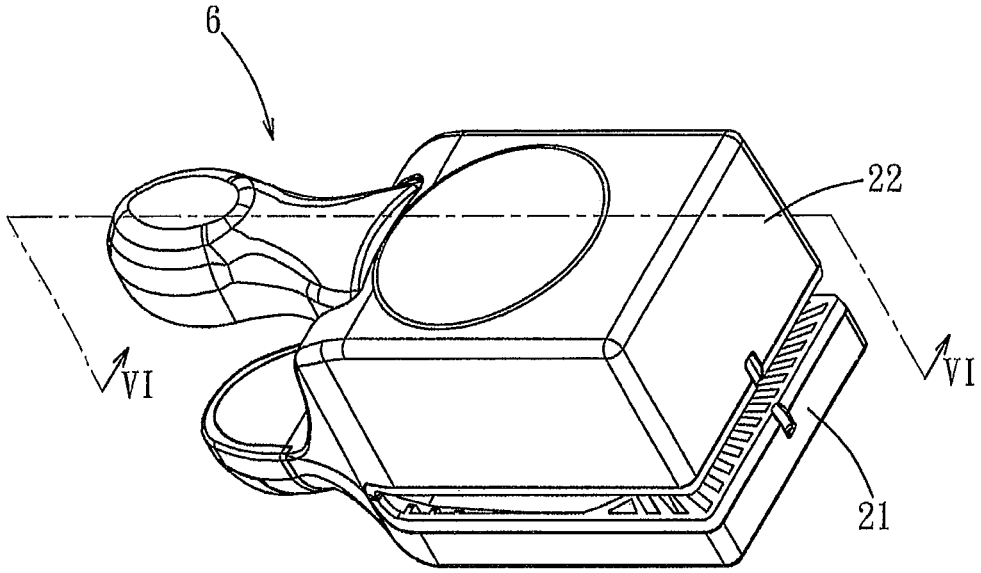
FIG. 3 is an assembled perspective view of the first preferred embodiment of a punching device according to this invention.
Figure 4:
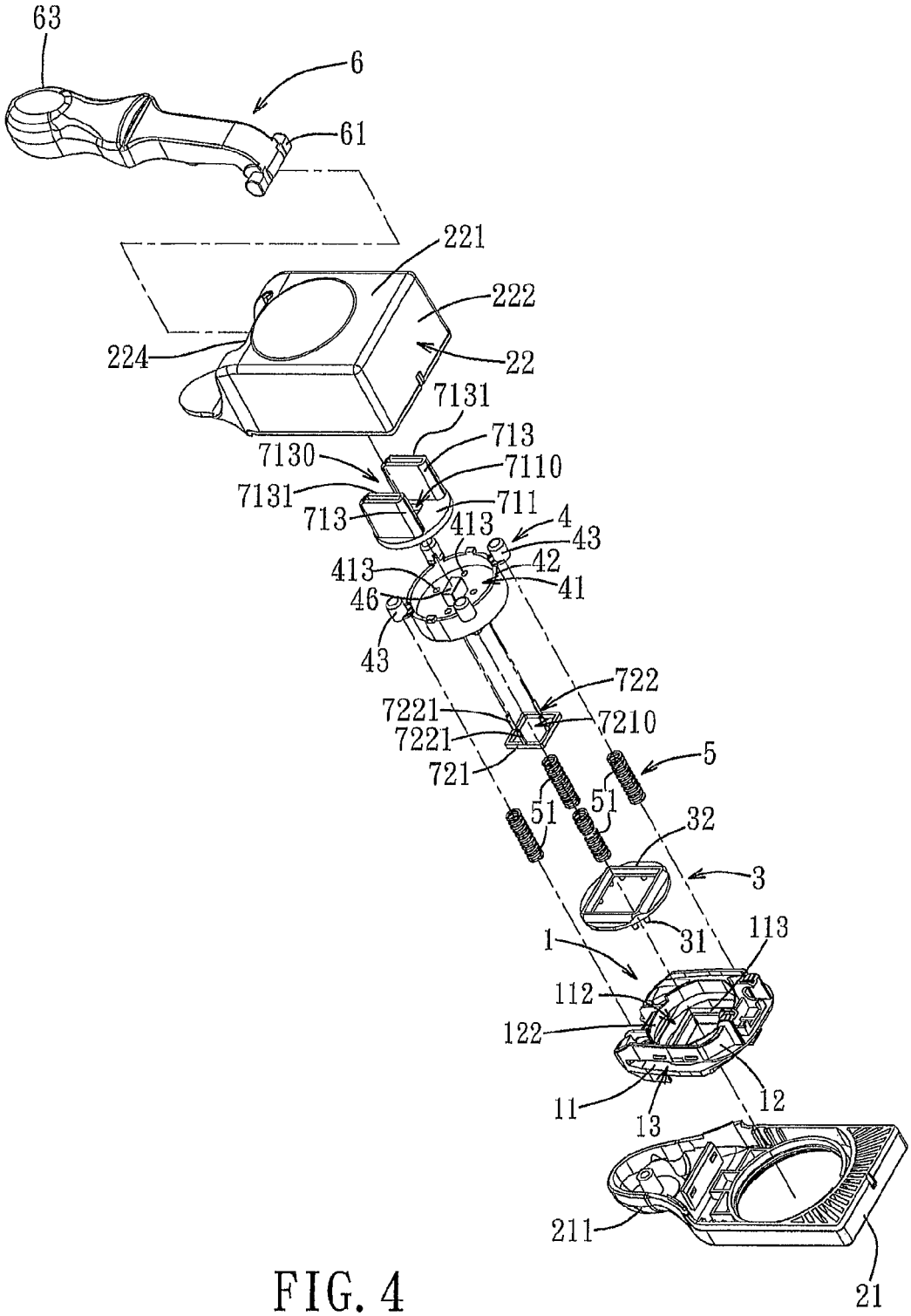
FIG. 4 is an exploded top perspective view of the first preferred embodiment.
Figure 5:
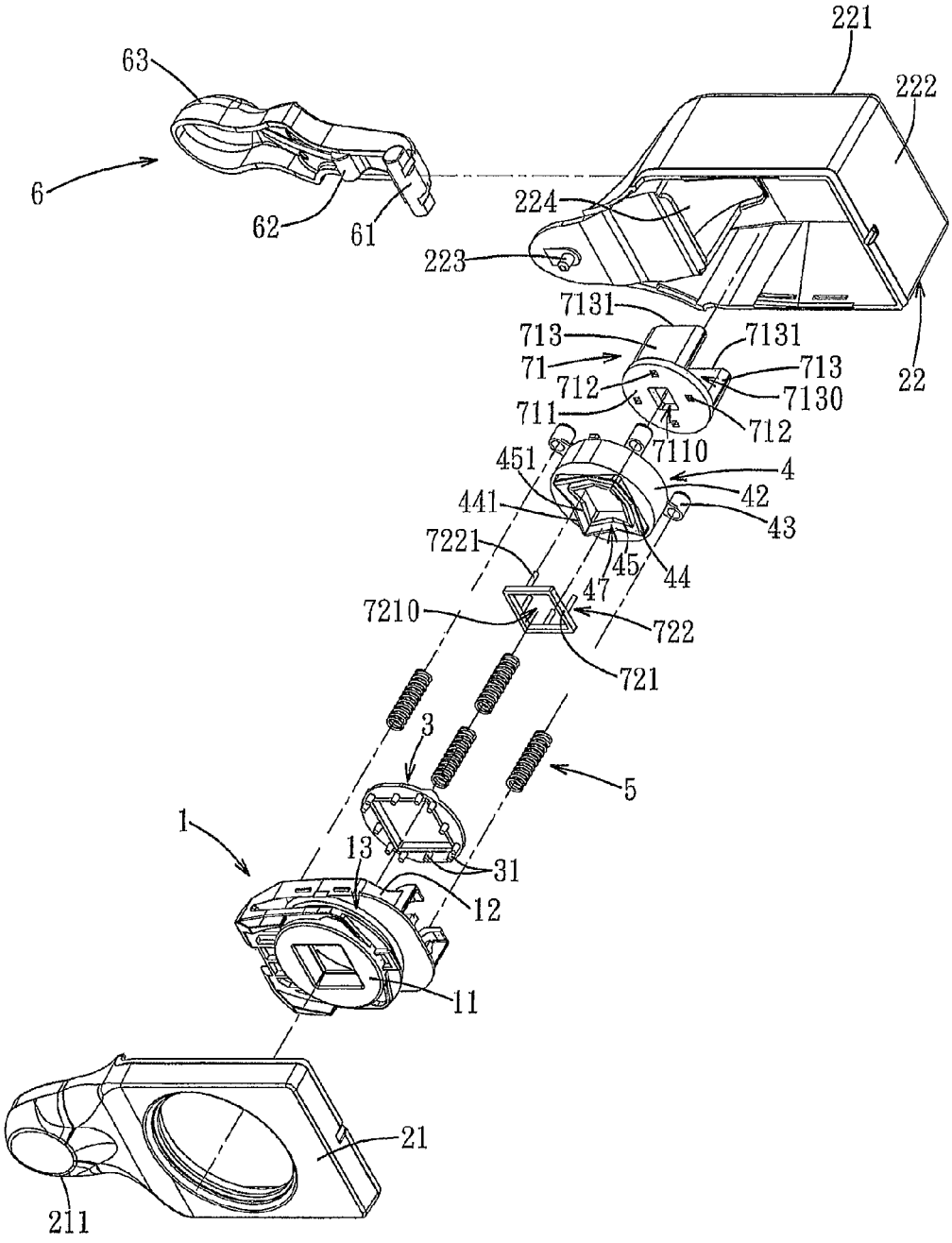
FIG. 5 is an exploded bottom perspective view of the first preferred embodiment.

Before the present invention is described in greater detail with reference to the accompanying preferred embodiments, it should be noted herein that like elements are denoted by the same reference numerals throughout the disclosure.

Figure 11A:
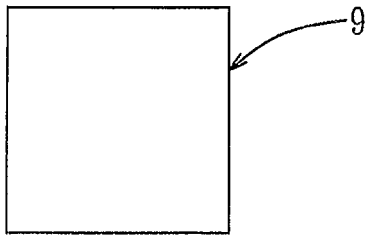
FIGS. 11A-11C are top views to illustrate how a workpiece is cut to form desired cutout portions by the first preferred embodiment.
Figure 11B:
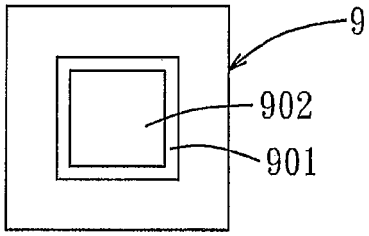
Figure 11C:
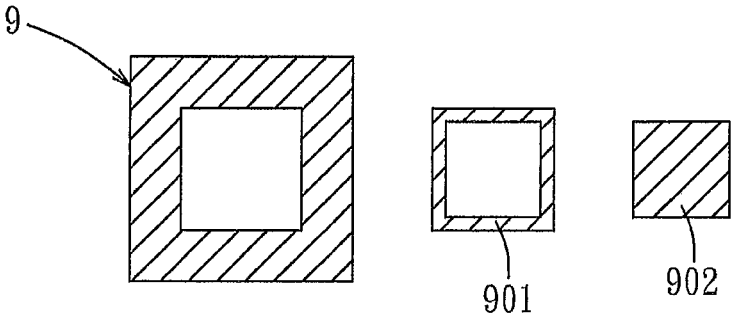

Referring to FIGS. 3 to 8, the first preferred embodiment of a punching device for cutting a workpiece 9 configured as a sheet of paper to form first and second cutout portions 901, 902 (see FIGS. 11A-11C) according to the present invention is shown to include a lower housing 21, a base 1, a spring-biased punch 4, an operating lever 6, an upper housing 22 connected securely to the base 1 and serving as an abutting member, and an ejecting unit 7.

Figure 9:
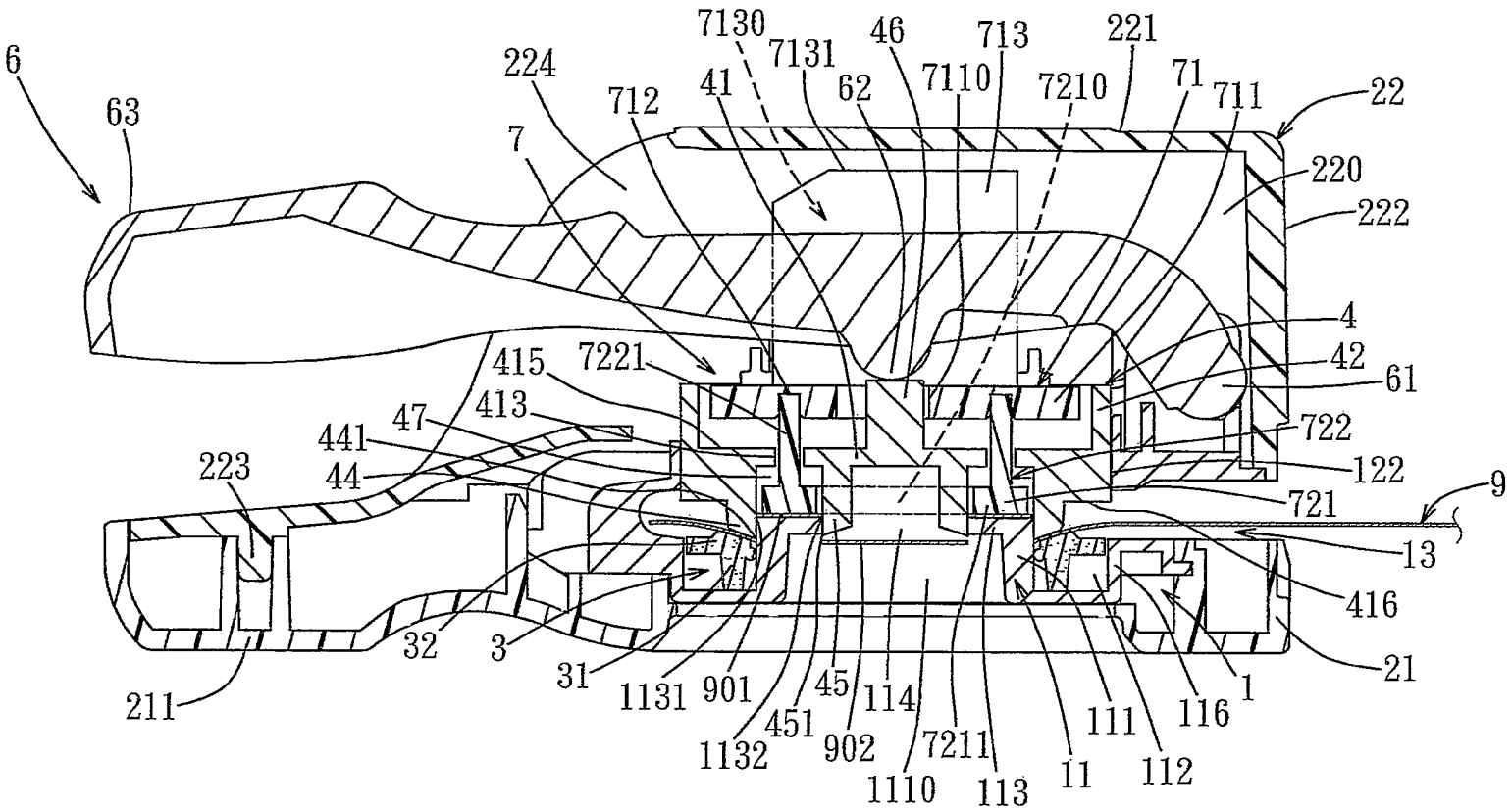
FIG. 9 is a sectional view of the first preferred embodiment, illustrating a state where the punch is disposed at a lower position.

The base 1 includes a die part 11 with a loop-shaped top wall 113 defining outer and inner die edges 1131, 1132 and adapted to support the first cutout portion 901 (see FIG. 9) thereon, and a loop-shaped support part 12 disposed above the die part 11 and connected to and cooperating with the die part 11 to form a U-shape body and to define an accommodating space 13 therebetween for receiving the workpiece 9 to be punched. The loop-shaped support part 12 is formed with a frame space 122 for extension of the punch 4 and the ejecting unit 7 therethrough, and has a plurality of studs 123 protruding therefrom.

The upper housing 22 has a top wall 221 and a surrounding wall 222 that extends downwardly from the top wall 221 and that is formed with a lever opening 224. The surrounding wall 222 has a lower end that is secured to the support part 12, and cooperates with the top wall 221 and the support part 12 to define a housing space 220 therebetween.

The punch 4 is a single piece made of a metallic material, is disposed in the housing space 220, and includes a circular head wall 41 having top and bottom surfaces 415, 416, a driven protrusion 46 protruding upwardly from the top surface 415, a peripheral wall 42 extending upwardly from a periphery of the head wall 41, loop-shaped outer and inner blades 44, 45 extending downwardly from the bottom surface 416 of the head wall 41 and disposed below the head wall 41, and a plurality of hollow retainers 43 formed on the peripheral wall 42. The punch 4 is provided with an urging member 5 that includes a plurality of coil springs 51, each of which extends into a respective one of the hollow retainers 43 and is sleeved on a respective one of the studs 123 (see FIG. 7) to abut against the support part 12 so that the punch 4 can be movably supported on the support part 12 of the base 1 through the urging member 5 and that the punch 4 is movable relative to the die part 11 of the base 1 and the abutting member defined by the upper housing 22 between upper and lower positions (see FIGS. 6 and 9). The punch 4 has outer and inner blade edges 441, 451 defined by the outer and inner blades 44, 45, respectively. The outer and inner blade edges 44, 45 of the punch 4 are slidable toward the outer and inner die edges 1131, 1132 of the die part 11 to provide a shear force for cutting the workpiece 9.

Figure 6:
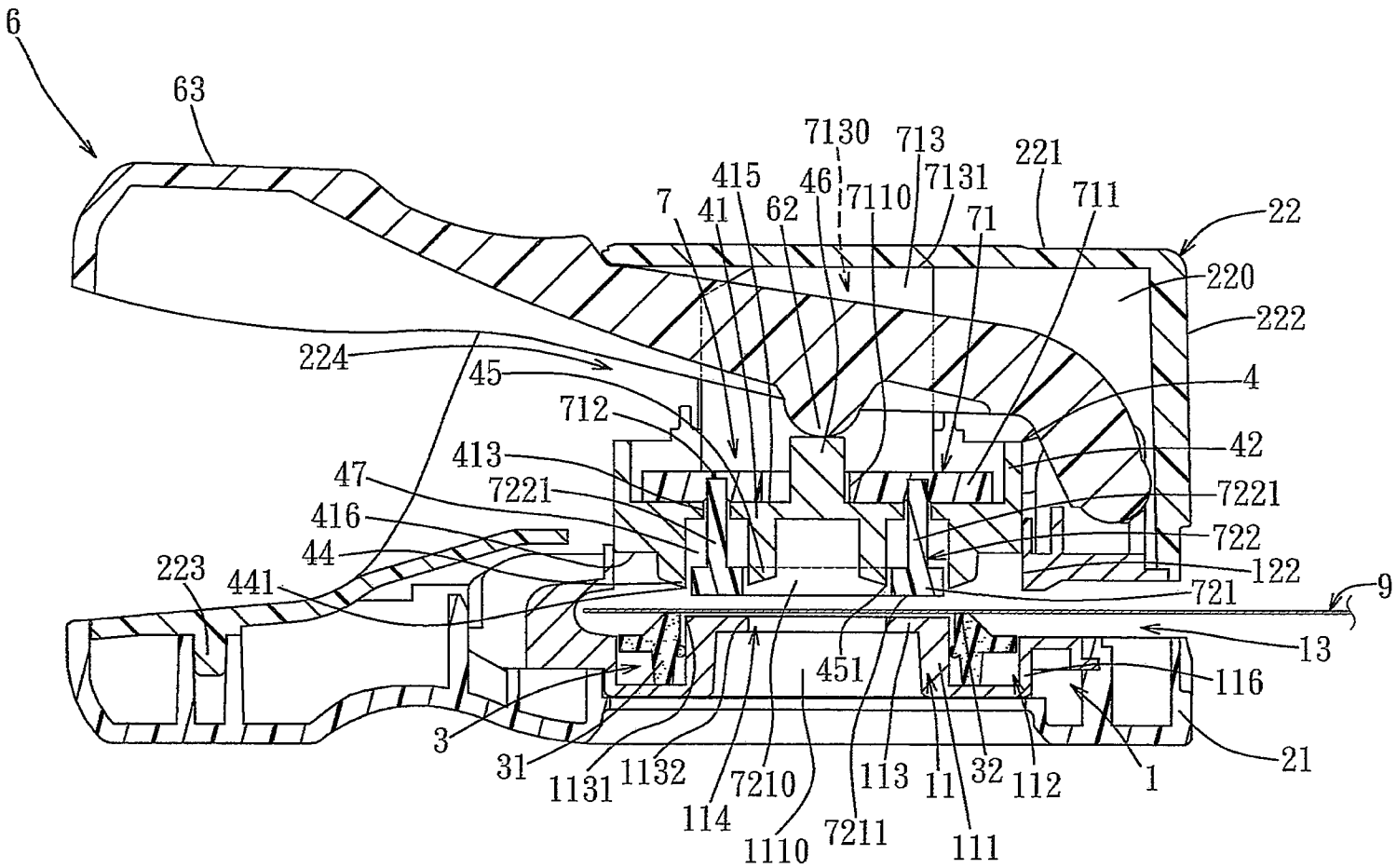
FIG. 6 is a sectional view of the first preferred embodiment taken along line VI-VI of FIG. 3, illustrating a state where a punch is disposed at an upper position before punching.
Figure 6A:
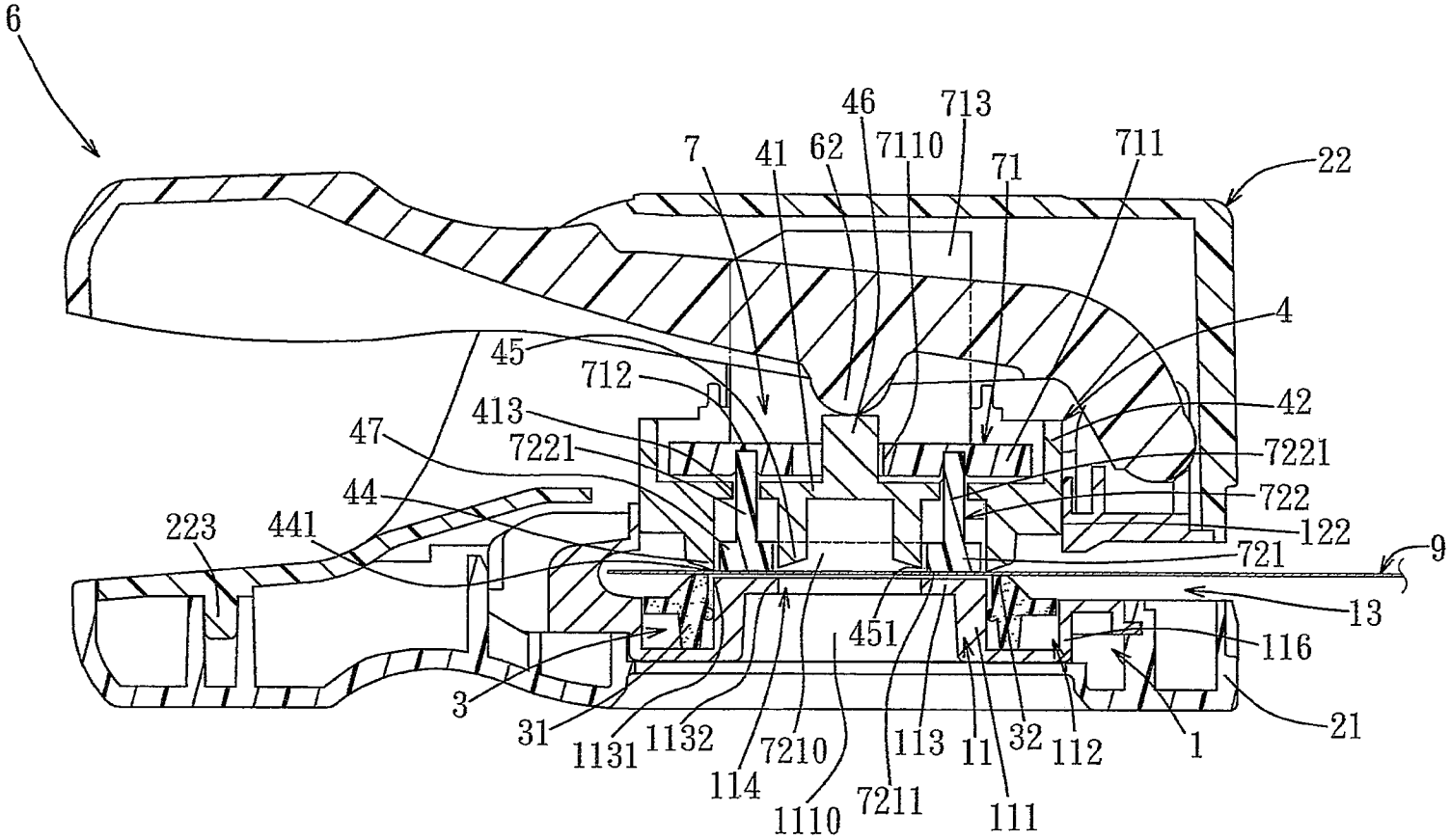
FIG. 6A is a sectional view of the first preferred embodiment, illustrating a state where the punch is disposed at a middle position.
Figure 7:
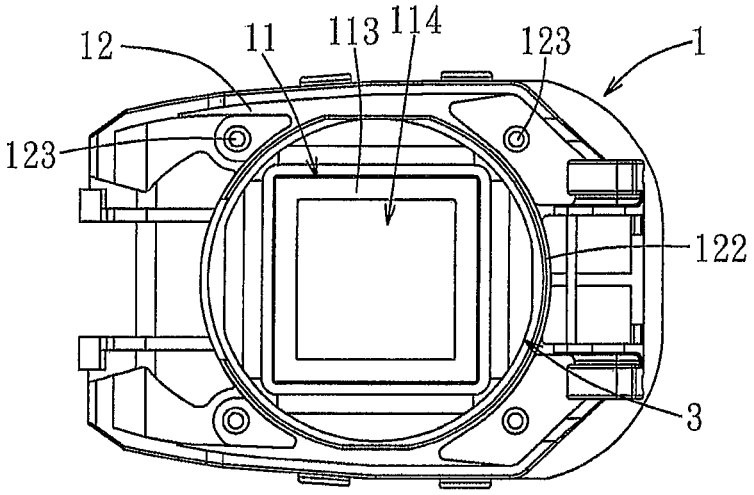
FIG. 7 is a schematic top view of a base and an elastic pad of the first preferred embodiment.
Figure 8:
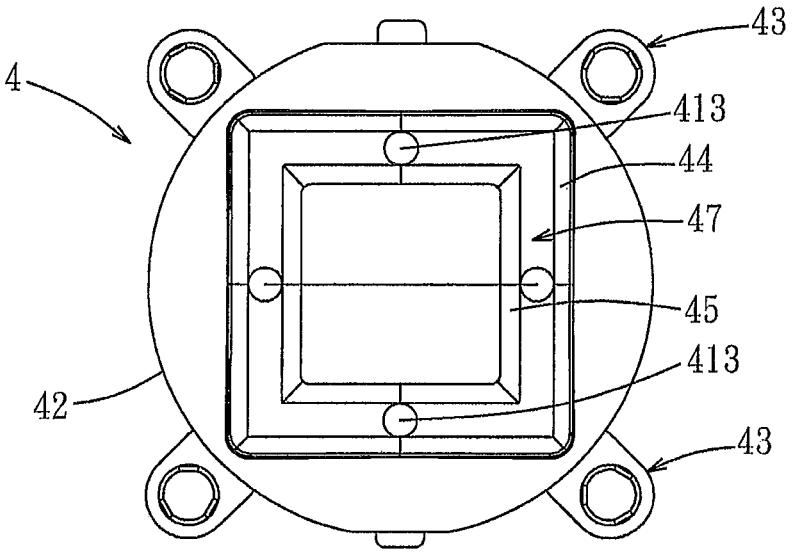
FIG. 8 is a schematic top view of the punch of the first preferred embodiment.
Figure 10:
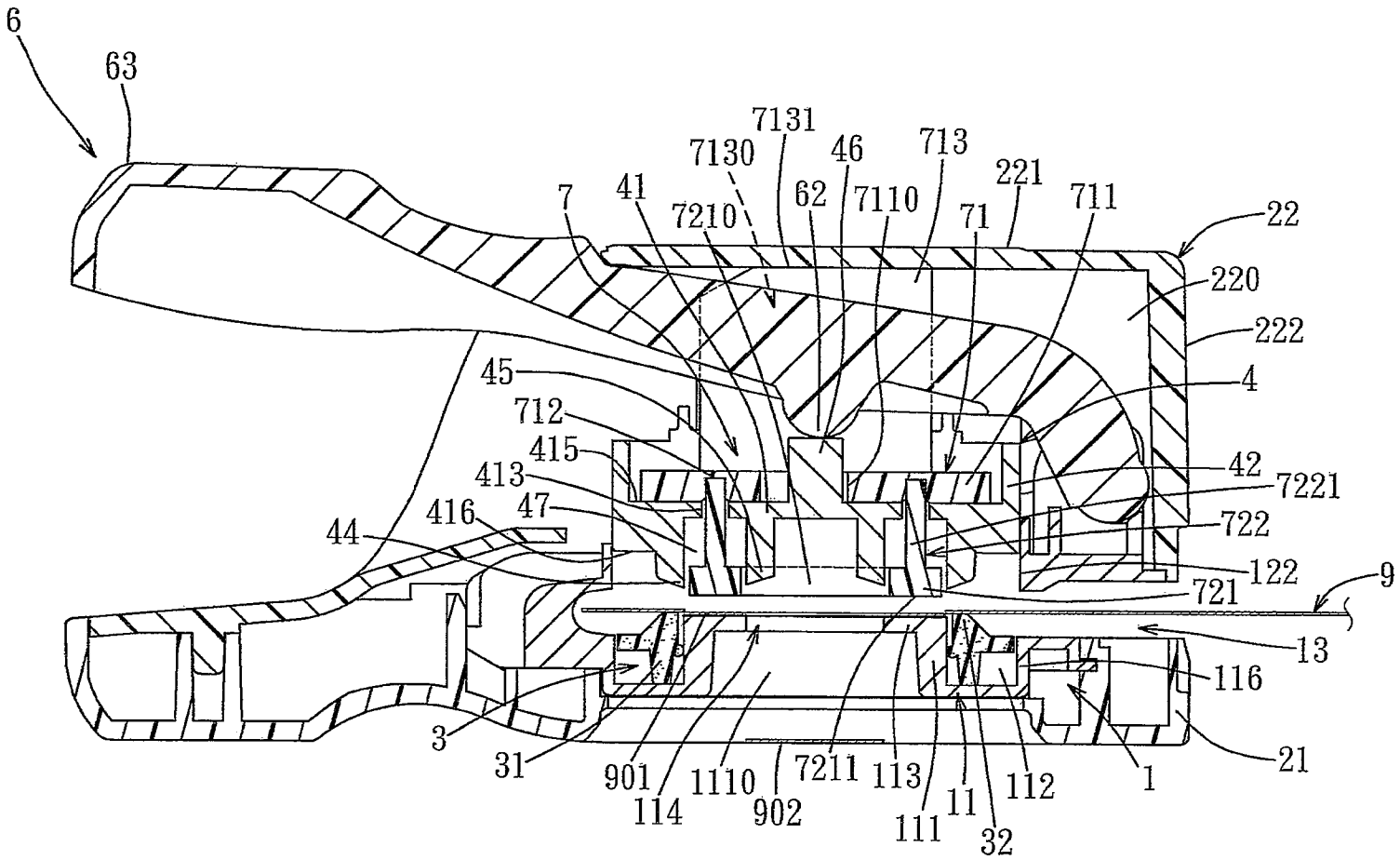
FIG. 10 is a sectional view of the first preferred embodiment, illustrating a state where the punch is disposed at the upper position after punching.

The ejecting unit 7 is disposed in the housing space 220 over the top wall 113 of the die part 11, and includes a non-compressible upper holder 71 disposed above the head wall 41 of the punch 4, a non-compressible loop-shaped ejecting element 721 disposed in the gap 47 below the head wall 41 and in the form of a rectangular frame which defines a frame space 7210, and a non-compressible interconnecting member 722 extending through the head wall 41 of the punch 4 and interconnecting the upper holder 71 and the ejecting element 721. The ejecting element 721 is disposed above and is spaced apart from the top wall 113 of the die part 11, and the inner blade edge 451 of the inner blade 45 is received in the frame space 7210 of the ejecting element 721 when the punch 4 is disposed at the upper position (see FIGS. 6 and 10). The ejecting element 721 nearly abuts against the top wall 113 of the die part 11, the inner blade edge 451 of the inner blade 45 is received in the frame space 7210, and the outer and inner blade edges 441, 451 are nearly flush with the outer and inner die edges 1131, 1132 when the punch 4 is disposed at a middle position (see FIG. 6A) between the upper and lower positions. The ejecting element 721 remains abutting against the top wall 113 of the die part 11 and the inner blade 45 extends through the frame space 7210 of the ejecting element 721 when the punch 4 is disposed at the lower position (see FIG. 9), i.e., the inner blade edge 451 of the inner blade 45 is disposed below the frame space 7210. The ejecting unit 7 is movably connected to the punch 4 such that the ejecting unit 7 is indirectly supported on the base 1 through the punch 4 when the punch 4 is disposed between the upper and middle positions, and is directly supported on the top wall 113 of the die part 11 of the base 1 when the punch 4 is disposed between the middle and lower positions.

The upper holder 71 of the ejecting unit 7 is slidably sleeved on the driven protrusion 46 so as to permit the ejecting unit 7 to be movably supported on the head wall 41 of the punch 4 when the punch 4 is disposed at the upper position, which, in turn, permits co-movement of the ejecting unit 7 with the punch 4 relative to the die part 11 during movement of the punch 4 from the upper position to the middle position, and further permits movement of the punch relative to the ejecting unit 7, which remains stationary, during movement of the punch 4 from the middle position to the lower position. The ejecting unit 7 is blocked against co-movement with the punch 4 by the top wall 113 of the die part 11 during movement of the punch 4 from the middle position to the lower position. In this preferred embodiment, the ejecting element 721 has a bottom end face 7211 that is disposed below the outer and inner blade edges 441, 451 when the punch 4 is disposed at the upper position (see FIGS. 6 and 10) so as to ensure that the bottom end face 7211 of the ejecting element 721 can be in contact with the first cutout portion 901 of the workpiece 9 for facilitating ejection of the first cutout portion 901 when the workpiece 9 is undesirably raised by the punch 4 upon restoration of the punch 4 to the upper position.

The head wall 41 of the punch 4 is further formed with a plurality of through-holes 413. The interconnecting member 722 has a plurality of connecting rods 7221, each of which extends upwardly from the ejecting element 721 through a respective one of the through-holes 413 in the head wall 41 to integrally connect with the upper holder 71. The upper holder 71 is formed with a plurality of retaining holes 712. Each of the connecting rods 7221 has an end fitted securely into a respective one of the retaining holes 712. In this embodiment, the ejecting element 721 and the connecting rods 7221 are non-flexible, and are preferably formed as a single piece from a non-elastic plastic material.

The lower housing 21 has one end 211 coupled detachably to one end 223 of the upper housing 22. The lower and upper housings 21, 22 cooperatively define a space for receiving the base 1, the punch 4, and the ejecting unit 7 therein. The die part 11 and the support part 12 engage detachably the lower and upper housings 21, 22, respectively, in a tongue-and-groove engaging manner. The upper housing 22 is disposed over and covers the ejecting unit 7. The upper holder 71 of the ejecting unit 7 has a horizontal plate 711 that is disposed on the head wall 41 and that is formed with the retaining holes 712 and an aperture 7110 for extension of the driven protrusion 46 of the punch 4 therethrough so as to permit the horizontal plate 711 to be sleeved slidably on the driven protrusion 46, and first and second vertical plates 713 that extend upwardly from the horizontal plate 711 and that have top free ends 7131. The top free ends 7131 of the first and second vertical plates 713 of the upper holder 71 of the ejecting unit 7 abut against the abutting member defined by the upper housing 22 when the punch 4 is disposed at the upper position so as to permit the ejecting element 721 to eject the first cutout portion 901 of the workpiece 9, which is undesirably raised from the top wall 113 of the die part 11 by the punch 4 during restoration of the punch 4 from the lower position to the upper position, from the punch 4.

The operating lever 6 has an operating free end 63 and a pivot end 61 that is opposite to the operating free end 63 and that is pivoted to the support part 12 of the base 1 so as to be rotatable relative to the support part 12. The operating lever 6 extends from the pivot end 61 through the lever opening 224 of the surrounding wall 222 of the upper housing 22 such that the operating free end 63 is disposed outwardly of the housing space 220. In this preferred embodiment, the operating lever 6 is formed with a driving tongue 62 that is disposed between the pivot end 61 and the operating free end 63 and that protrudes therefrom into the housing space 220 to abut against the driven protrusion 46 of the punch 4 for driving movement of the punch 4 from the upper position to the lower position when the operating lever 6 rotates downwardly relative to the support part 12. The first and second vertical plates 713 cooperatively define therebetween a vertical slot 7130 that is disposed between the top wall 221 and the head wall 41. The operating lever 6 extends into and through the vertical slot 7130. The driving tongue 62 is disposed in the vertical slot 7130.

The outer and inner blades 44, 45 cooperatively define a loop-shaped gap 47 therebetween. The ejecting element 721 is spaced apart from the outer and inner blades 44, 45 and the bottom surface 416 of the head wall 41, extends into the loop-shaped gap 47 when the punch 4 is disposed at the upper position, and is entirely received in the loop-shaped gap 47 when the punch 4 is disposed at the lower position. The top wall 113 of the die part 11 has an opening 114. The die part 11 further has an inner surrounding wall 111 that extends downwardly from the top wall 113 and that defines an inner space 1110 in spatial communication with the opening 114 for receiving the second cutout portion 902 of the workpiece 9, and an outer surrounding wall 116 that is connected to and that surrounds the inner surrounding wall 111 and that cooperates with the inner surrounding wall 111 to define a receiving space 112 therebetween. The outer and inner blades 44, 45 extend into the receiving space 112 and the opening 114, respectively, when the punch 4 is disposed at the lower position. A loop-shaped elastic pad 3 is disposed in the receiving space 112, and has a loop-shaped top end 32 and a plurality of legs 31 extending downwardly from the loop-shaped top end 32 and seated on a bottom of the die part 11. The top end 32 of the elastic pad 3 is disposed slightly above the top wall 113 of the die part 11 for supporting the workpiece 9 thereon, and is spaced apart from the outer blade 44 when the punch 4 is disposed at the upper position. The top end 32 of the elastic pad 3 is disposed below the top wall 113 of the die part 11 and is compressed by the outer blade 44 when the punch 4 is disposed at the lower position.

In this embodiment, the bottom end face 7211 of the ejecting element 721 is flat.

In operation, when the punch 4 is disposed at the upper position, the outer and inner blade edges 441, 451 are disposed above the outer and inner die edges 1131, 1132, the top free ends 7131 of the first and second vertical plates 713 abut against the top wall 221 of the upper housing 22, the horizontal plate 711 is seated on the top surface 415 of the head wall 41, and the ejecting element 721 is spaced apart from the die part 11. When the punch 4 is disposed at the lower position, the outer and inner blade edges 441, 451 are disposed below the outer and inner die edges 1131, 1132, the top free ends 7131 of the first and second vertical plates 713 are spaced apart from the top wall 221 of the upper housing 22, the horizontal plate 711 is spaced apart from the top surface 415 of the head wall 41, and the electing element 721 is seated on the die part 11.

Figure 12:
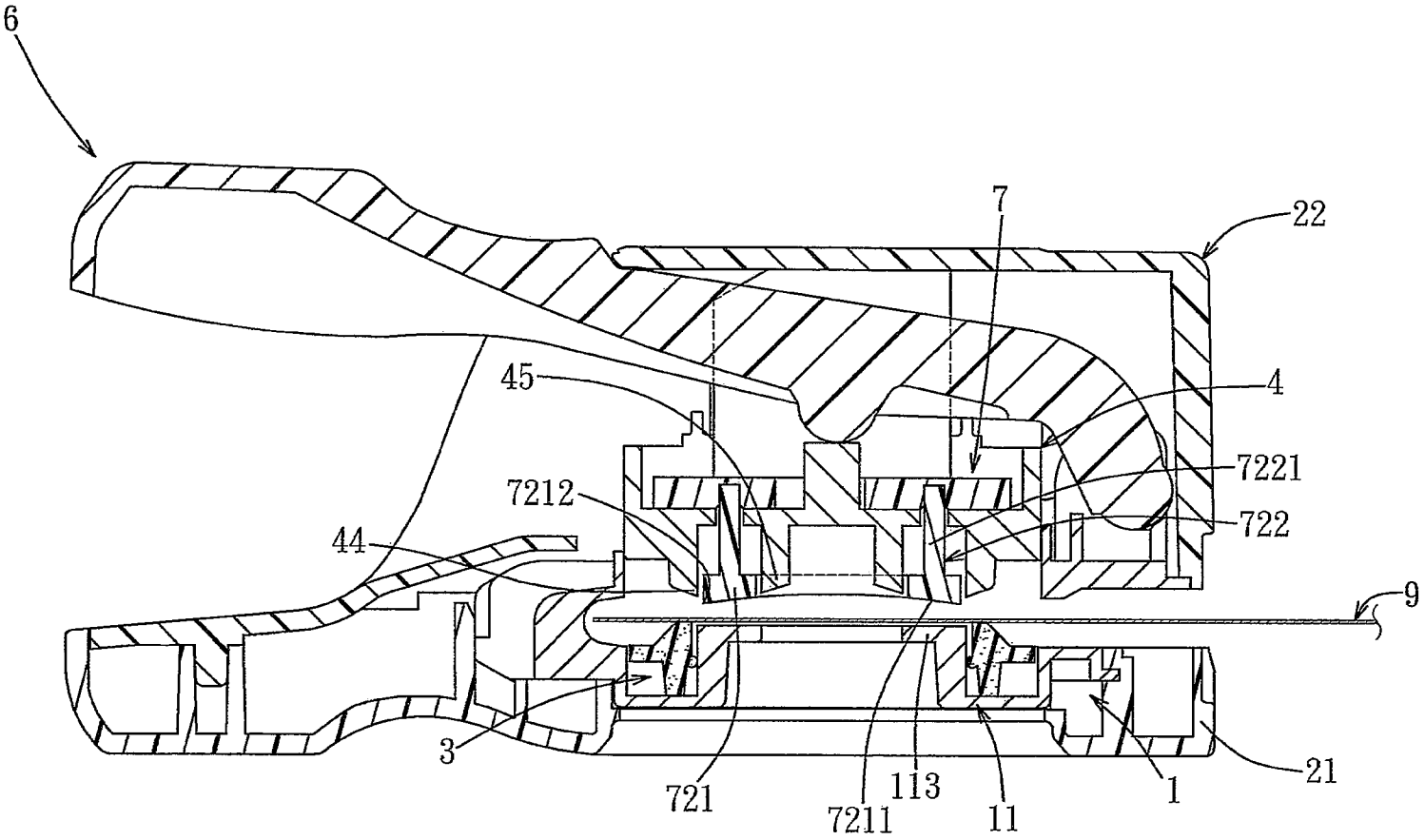
FIG. 12 is a sectional view of the second preferred embodiment of a punching device according to this invention.
Figure 13:
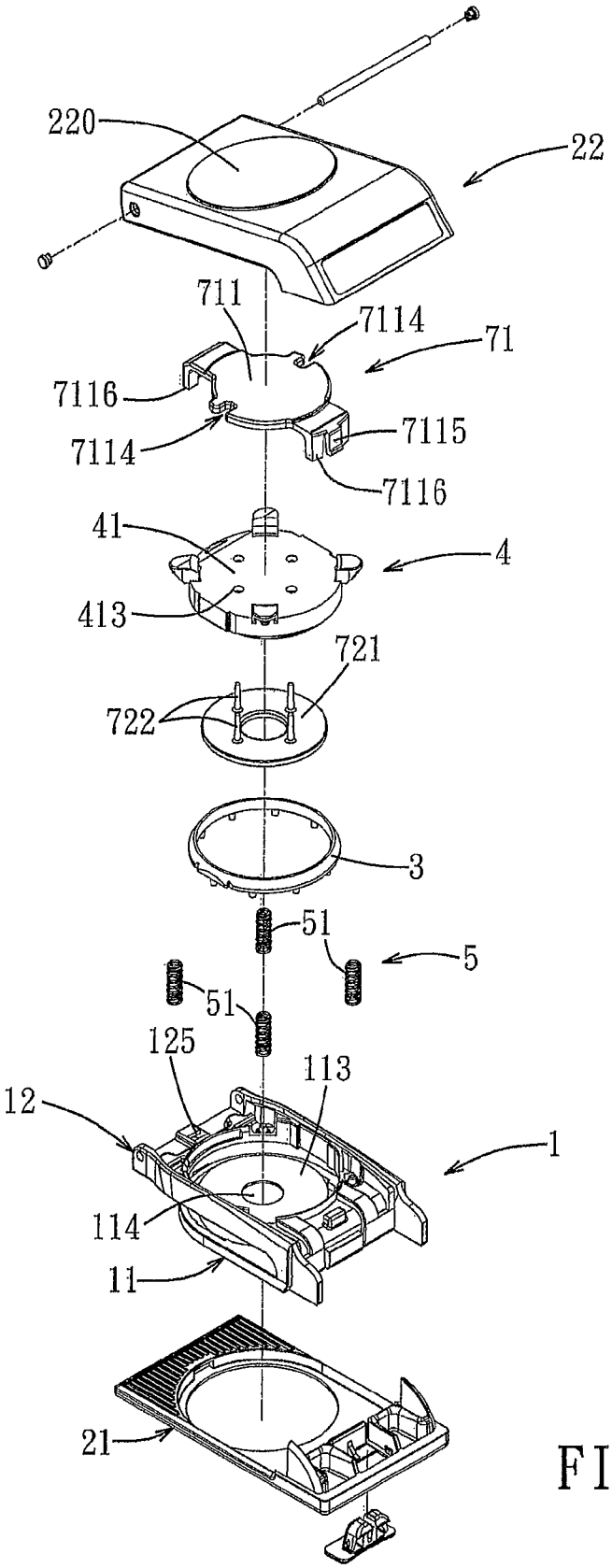
FIG. 13 is an exploded top perspective view of the third preferred embodiment.
Figure 14:
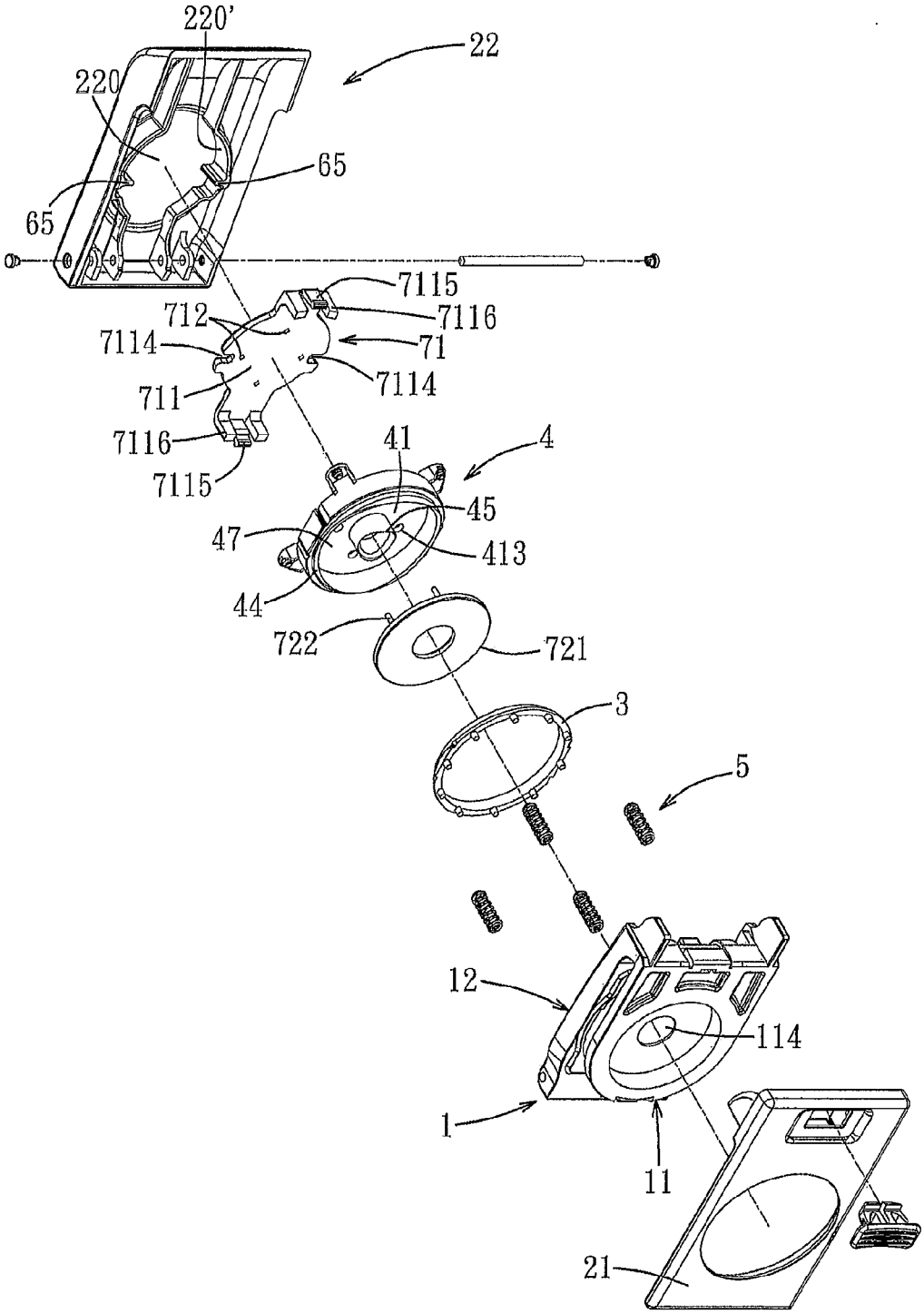
FIG. 14 is an exploded bottom perspective view of the third preferred embodiment.

FIG. 12 illustrates the second preferred embodiment of the punching device according to this invention. The second preferred embodiment differs from the previous embodiment in that the bottom end face 7211 of the ejecting element 721 is concave and has an outer peripheral edge 7212. The outer peripheral edge 7212 of the bottom end face 7211 of the ejecting element 721 abuts against the first cutout portion 901 of the workpiece 9, which is undesirably raised by the punch 4 during restoration of the punch 4 from the lower position to the upper position, to deform the first cutout portion 901 when the punch 4 is moved to the upper position, thereby facilitating ejection of the first cutout portion 901 from the punch 4.

FIGS. 13 to 16 illustrate the third preferred embodiment of a punching device according to this invention. The third preferred embodiment differs from the previous embodiments in that the upper holder 71 is secured to the support part 12 of the base 1 in a snap-fitting manner so as to permit movement of the punch 4 relative to the ejecting unit 7 during movement of the punch 4 between the upper and lower positions (see FIGS. 15 and 16). The support part 12 of the base 1 is further formed with two opposite abutting pieces 125 that cooperatively define an abutting member. The upper holder 71 has an horizontal plate 711 disposed over the head wall 41, connected to the ejecting element 721 by the interconnecting member 722, and formed with two opposite clamping arms 7115 that abut against and engage the abutting pieces 125, respectively, in a neck-and-shoulder snap-engaging manner so as to prevent upward movement of the ejecting unit 7 relative to the base 1. The horizontal plate 711 of the upper holder 71 is further formed with two opposite abutting portions, each of which includes a pair of abutting legs 7116 that are disposed respectively at two opposite sides of a respective one of the clamping arms 7115 and that abut against the support part 12 so as to prevent downward movement of the ejecting unit 7 relative to the base 1.

Figure 15:
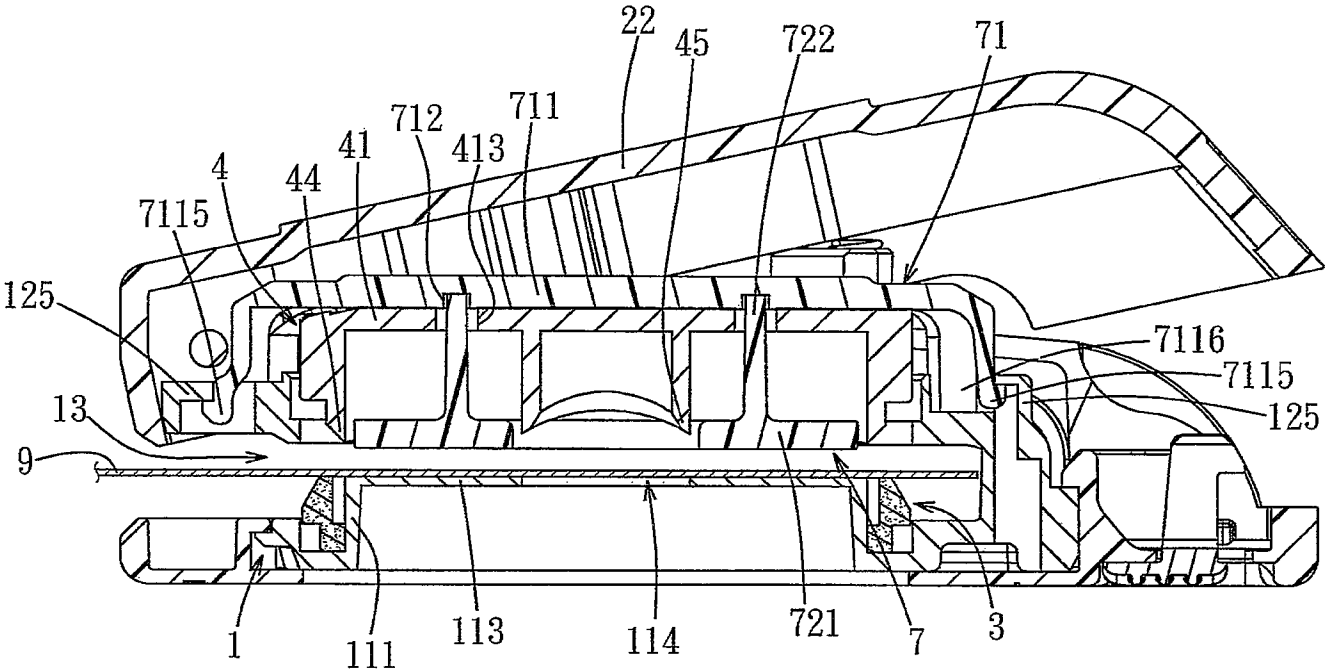
FIG. 15 is a sectional view of the third preferred embodiment, illustrating a state where an upper housing is disposed at a first angular position and a punch is disposed at an upper position.
Figure 16:
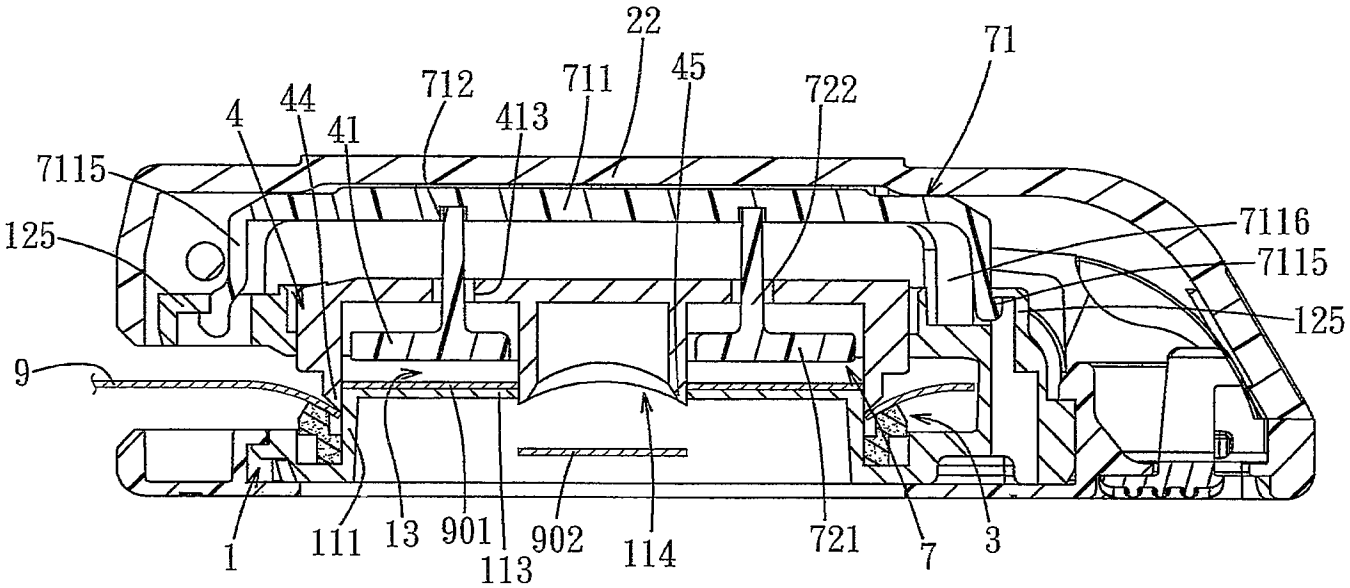
FIG. 16 is a sectional view of the third preferred embodiment, illustrating a state where the upper housing is disposed at a second angular position and the punch is disposed at a lower position.

In this embodiment, the upper housing 22 is pivoted to the support part 12 of the base 1 so as to be rotatable relative to the base 1 between first and second angular positions (see FIGS. 15 and 16). The upper housing 22 is formed with a middle recess 220 defined by a recess-defining wall 220'. The recess-defining wall 220' is formed with two opposite pressing projections 65 protruding into the middle recess 220. The horizontal plate 711 of the upper holder 71 is further formed with two opposite cutouts 7114. The pressing projections 65 are disposed above the horizontal plate 711 when the upper housing 22 is disposed at the first angular position, and extend through the cutouts 7114 to press against the head wall 41 of the punch 4 when the upper housing 22 is disposed at the second angular position so as to drive movement of the punch 4 from the upper position to the lower position.

With the inclusion of the abutting member defined by the upper housing 22 of the first or second preferred embodiment or by the abutting pieces 125 of the third preferred embodiment in the punching device of this invention for limiting the ejecting unit 7, the aforementioned drawbacks associated with the prior art can be eliminated.

With the invention thus explained, it is apparent that various modifications and variations can be made without departing from the spirit of the present invention.

What is claimed is:

1. A punching device for cutting a workpiece to form a cutout portion, comprising:

a base including a die part and a support part that is disposed above and that cooperates with said die part to define an accommodating space for receiving the workpiece therein;

an upper housing having a top wall and a surrounding wall that extends downwardly from said top wall and that is formed with a lever opening, said surrounding wall having a lower end that is secured to said support part, and cooperating with said top wall and said support part to define a housing space therebetween;

a punch of a single piece disposed in said housing space, supported movably on said support part, movable relative to said die part between upper and lower positions, and having a head wall, a driven protrusion, and outer and inner blades, said head wall having top and bottom surfaces and being formed with a plurality of through-holes that extend through said top and bottom surfaces, said driven protrusion protruding upwardly from said top surface of said head wall, said outer and inner blades extending downwardly from said bottom surface to slide against said die part for cutting the workpiece, and cooperatively defining a gap therebetween;

an ejecting unit disposed in said housing space and including a non-compressible ejecting element, a plurality of connecting rods, a horizontal plate, and a first vertical plate, said ejecting element being disposed in said gap below said head wall, said connecting rods extending upwardly from said ejecting element and respectively passing through said through-holes in said head wall to integrally connect with said horizontal plate, said horizontal plate being disposed on said head wall and being formed with an aperture, said driven protrusion extending through said aperture so as to permit said horizontal plate to be slidably sleeved on said driven protrusion, said first vertical plate extending upwardly from said horizontal plate;

an operating lever having a pivot end, an operating free end opposite to said pivot end, and a driving tongue, said pivot end being pivoted to said support part, said operating lever extending through said lever opening in said surrounding wall, such that said operating free end is disposed outwardly of said housing space, said driving tongue being disposed between said pivot end and said operating free end, and protruding therefrom into said housing space to abut against said driven protrusion so as to drive movement of said punch from said upper position to said lower position when said operating lever rotates downwardly relative to said support part; and at least one spring urging said punch for restoring said punch from said lower position to said upper position;

wherein, when said punch is disposed at the upper position, said first vertical plate abuts against said top wall of said upper housing, said horizontal plate is seated on said top surface of said head wall, and said ejecting element is spaced apart from said die part; and wherein, when said punch is disposed at the lower position, said first vertical plate is spaced apart from said top wall of said upper housing, said horizontal plate is spaced apart from said head wall, and said ejecting element is seated on said die part.

2. The punching device of claim 1, wherein said ejecting unit further includes a second vertical plate that extends upwardly from said horizontal plate and that cooperates with said first vertical plate to define therebetween a vertical slot that is disposed between said top wall and said head wall, said operating lever extending through said vertical slot, said driving tongue being disposed in said vertical slot.

3. The punching device of claim 1, wherein said ejecting element is spaced apart from said outer and inner blades and said bottom surface of said head wall.

4. The punching device of claim 1, wherein said ejecting element and said connecting rods are formed as a single piece of a plastic material.

* * * * *